United States Patent [19]

Otremba

[11] 4,361,818

[45] Nov. 30, 1982

[54] BALANCED CONVERTER FOR MICROWAVE RANGE

[75] Inventor: Klaus Otremba, Munich, Fed. Rep. of Germany

[73] Assignee: Siemens Aktiengesellschaft, Berlin & Munich, Fed. Rep. of Germany

[21] Appl. No.: 162,158

[22] Filed: Jun. 23, 1980

[30] Foreign Application Priority Data

Jul. 20, 1979 [DE] Fed. Rep. of Germany ..... 2929522

[51] Int. Cl.[3] ..... H01P 5/10

[52] U.S. Cl. ..... 333/26; 332/52; 333/238

[58] Field of Search ..... 333/26, 238, 246; 332/43 B, 52

[56] References Cited

U.S. PATENT DOCUMENTS 3,093,805 6/1963 Osifchin et al. ..... 333/238 X 3,818,385 6/1974 Mouw ..... 333/26

4,125,810 11/1978 Pavio ..... 333/26 X

*Primary Examiner*—Paul L. Gensler

*Attorney, Agent, or Firm*—Hill, Van Santen, Steadman, Chiara & Simpson

[57] ABSTRACT

A balanced converter for the microwave range which allows simple construction of modulators and similar electrical assemblies which have particularly good properties as far as noise level and decoupling are concerned. A first embodiment is constructed in microstrip line technology and provides a transition from a line which is asymmetrical to ground and a microstrip and coplanar line to a line which is symmetrical to ground and in which the embodiment is formed from metal strips arranged on a dielectric plate. A second embodiment of the balanced converter is constructed in triplate technology.

9 Claims, 4 Drawing Figures

Best Available Copy

BALANCED CONVERTER FOR MICROWAVE RANGE

BACKGROUND OF THE INVENTION

1. Field of the Invention

This invention relates to a balanced converter for the microwave range as used, for example, for the construction of modulators such as the so-called double push-pull modulator also known as ring modulators.

2. Description of the Prior Art

These types of modulators generally consist of two balanced converters and a diode quartet and this modulator technique is known from the telephone technology particularly in the low frequency range. However, it is difficult to construct the transformer or equivalent circuit for the microwave range since the type of lines used in microwave circuits are generally asymmetrical to ground and it is not possible to use balanced converters with windings in the microwave field.

SUMMARY OF THE INVENTION

It is an object of the present invention to provide a balanced converter for the microwave range which can be used to produce modulators and similar electrical assemblies having good noise level and decoupling properties which can be constructed in a simple manner.

The object of the invention is accomplished with a first embodiment which comprises a balanced converter designed in microstrip technology such that a first metallic conductor path is arranged on one surface of a dielectric plate which can be mounted in a metallic housing and two metallic conductor paths which have approximately a quarter wave length and are mounted on both sides of the first conductor path and parallel thereto and are each respectively conductively connected to wider metallic conductor paths which form ground lines and have quarter wave lengths and are mounted on the opposite surface of the dielectric plate. The wider metallic conductor paths have end zones which are connected to the metallic housing. A pair of conductor paths on the first side of the plate or dielectric material run at right angles to the conductor paths and connect to the conductor paths. Thus, the symmetrical lines extend in a first plane above and a second plane below the dielectric plate.

A further embodiment of the invention provides that the symmetrical lines run in two planes above one another in microstrip technology wherein a first metallic conductor path is arranged on one surface of a plate of dielectric material which can be mounted in a metallic housing and two metallic conductor paths of a quarter wave length are each arranged on both sides of this conductor path and parallel thereto and are each electrically conductively connected to a wider metallic conductor path which forms an earth or ground line and has approximately a quarter wave length and is mounted on the opposite surface of the dielectric plate and which are connected at one end zone to the metallic housing. The conductor paths arranged on one side of the first conductor path and the ground line arranged opposite the second conductor path are each connected at their end zones to conductor paths and run at right angles and face each other on opposite sides of the surfaces of the dielectric plate.

An additional development of the invention is provided that the electrical connections between the approximately one quarter wave length conductor paths on one surface and the ground lines arranged on the opposite surface of the plate is accomplished with through contacts.

The first metallic conductor path is electrically connected to at least one of the conductor paths which have an approximate guarter wave length and are arranged on one side of the first conductor path or may be insulated depending upon whether the device is a simple arrangement or represents a compensated balanced device.

In a further embodiment according to the invention, the balanced converter is constructed in Triplate technology so that two dielectric plates are provided each of which have on one side two metallic coatings which extend in the longitudinal direction and are separated from each other by a recess and between their non-metallized surfaces which are arranged one above another enclose a conductor path which extends in a longitudinal direction of the plate. The conductor path and the metallic coating of one dielectric plate form the asymmetrical input and the metallic coatings of the dielectric plates which are separated from each other by the recesses form the symmetrical output of the transformer. The metallic coatings on the outer surfaces of the dielectric plates which are arranged opposite each other are advantageously electrically conductively connected to each other with through-contacts.

A further development of the invention provides that terminal points of the metallic coatings project laterally outward in the plane of the non-metallized surfaces of the dielectric plates which are arranged one above another.

By interconnecting two balanced converters and by providing a corresponding number of diodes, a RF modulator or similar electrical assembly can be constructed in a simple fashion.

Other objects, features and advantages of the invention will be readily apparent from the following description of certain preferred embodiments thereof taken in conjunction with the accompanying drawings although variations and modifications may be effected without departing from the spirit and scope of the novel concepts of the disclosure and in which:

DESCRIPTION OF THE PREFERRED EMBODIMENTS

Figure 1:
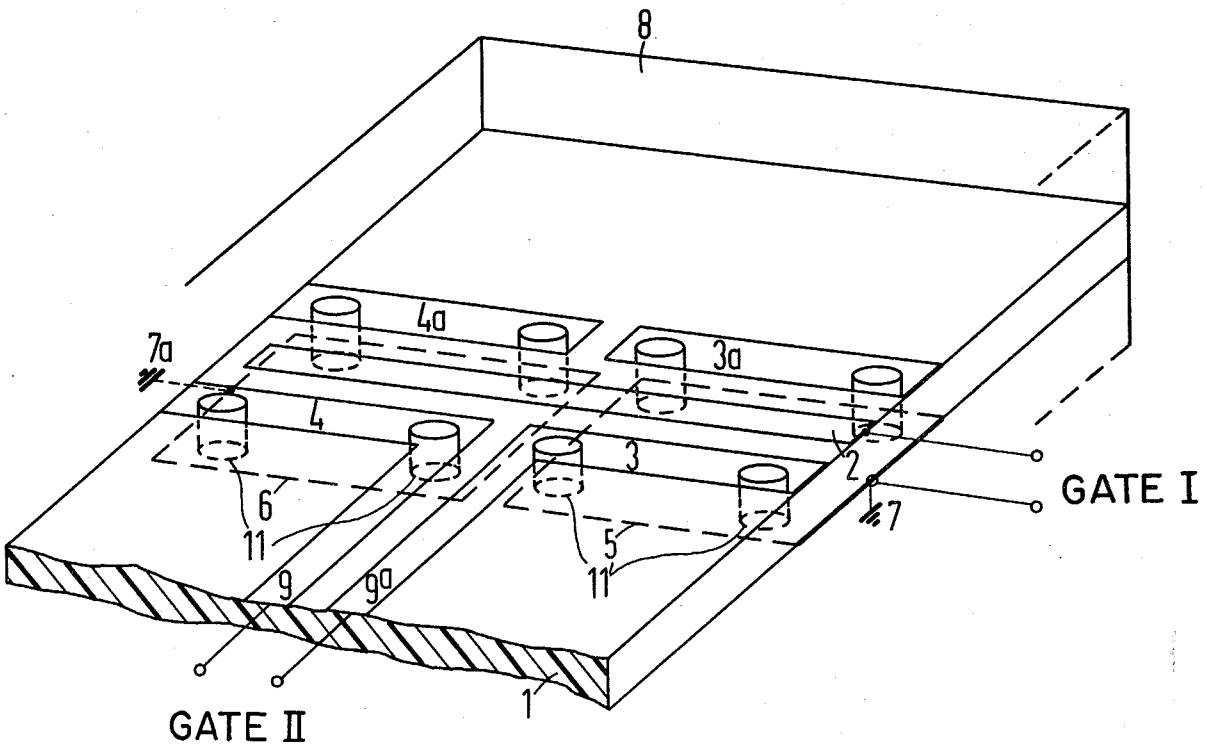
FIG. 1 illustrates in a perspective view a balanced converter in microstrip technology wherein the symmetrical lines are arranged in one plane.

FIG. 1 comprises a perspective view of a balanced converter according to the invention wherein the symmetrical lines run beside one another in one plane. For clarity the dielectric plate 1 and the metallic housing 8 in which the plate 1 is mounted are not shown completely but are only partially represented. On the upper surface of the dielectric plate 1 a conducting path 2 is provided which extends transversely of the plate 1 as shown. A first pair of conductor paths 3 and 4 each of which are approximately one quarter wave length are mounted on one side of the conductor path 2 and each extend approximately half-way across the plate 1. A second pair of conductor paths 3*a* and 4*a* are mounted on the top surface of the dielectric plate 1 and extend one quarter wave length across the plate 1 but are mounted on the side opposite of the path 2 to that which the conductive paths 3 and 4 are mounted as shown in FIG. 1.

On the lower surface of the dielectric plate 1 relative to FIG. 1 are formed, a pair of wider conductor paths 5 and 6 each of which are about one quarter wave length in length and which are aligned with each other across the plate on the lower surface and form a ground line. The conductor paths 5 and 6 are arranged so that they are opposite the conductor path 2 and the conductor paths 3 and 3*a*, 4 and 4*a*, respectively. The conductor paths 4 and 4*a* are electrically connected to the conductive path 6 by through contacts 11 as illustrated. The conductive path 5 is connected to the conductive paths 3 and 3*a* by through contacts 11′ as illustrated in FIG. 1. The conductor paths 3 and 4 which are arranged on a first side of the conductive path 2 and each of which have approximately a quarter wave length have adjacent ends connected to conductor paths 9 and 9*a* which extend at right angles to the conductor paths 4 and 3 and are parallel to each other on the upper side of the plate 1 as shown.

The conductor paths 5 and 6 each of which are a quarter wave length long and form the ground line have their ends 7 and 7*a*, respectively, connected to the metallic housing 8.

The conductor path 2 and the quarter wave length conductor paths 3, 3*a* and 5 form a line which is asymmetrical to ground. The conductor paths 4, 4*a* and 6 also form an asymmetrical line to ground. These lines also consist of a microstrip and coplanar line having the surge impedances $Z_0$ and $Z_K$ ($Z_K$ is equal to the surge impedance of the compensation line for the balanced device). The signal which is asymmetrical to ground is fed to the balanced device across line 2 and terminals 7 and 7*a* and the signal which is symmetrical to ground is fed to the device across strip line conductors 9 and 9*a*.

Figure 2:
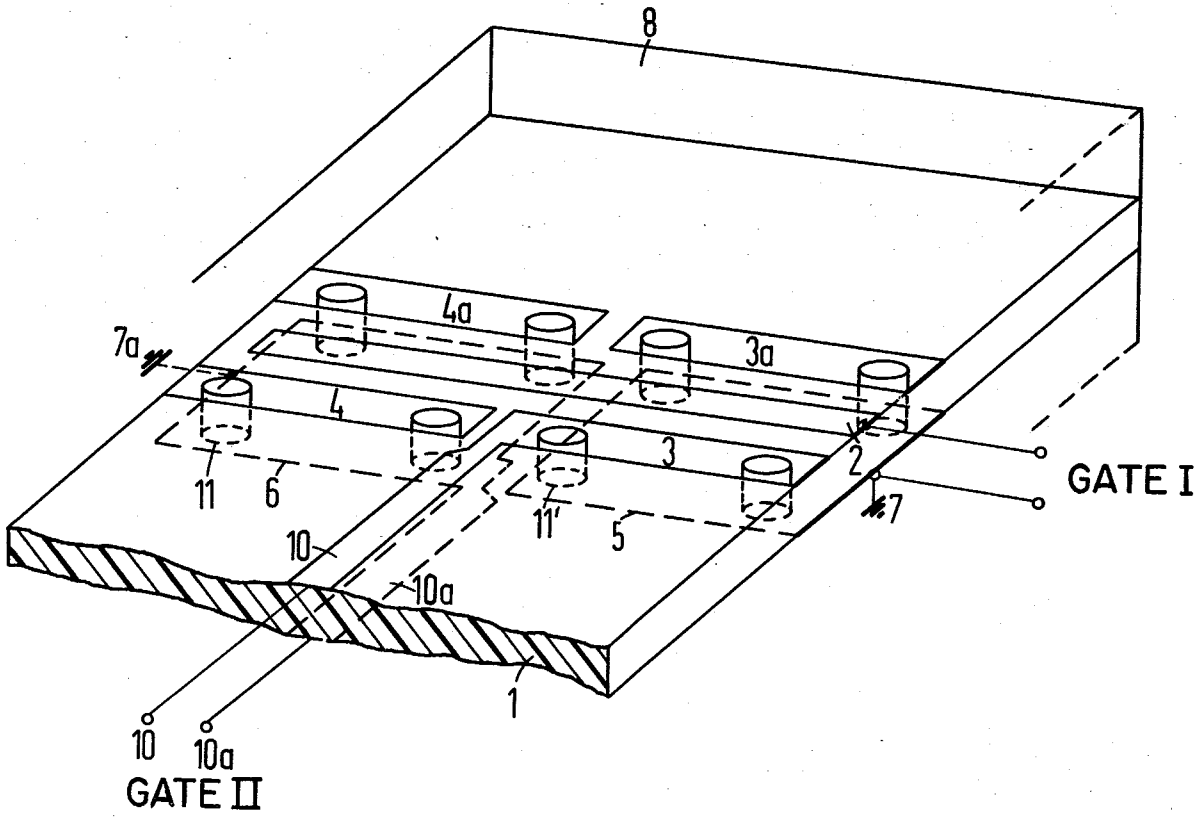
FIG. 2 illustrates a balanced converter in perspective constructed in microstrip technology in which the symmetrical lines are arranged in two planes.

The quarter wave length conductor paths 3, 3*a*, 5 and 4, 4*a* and 6 together with the metal housing 8 form strip lines having surge impedances of $Z_1$ and $Z_2$, respectively. The conductor path 2 forms a microstrip line with the wide conductor paths 5 and 6 (ground lines) and forms a coplanar line with the conductor paths 3, 3*a* and 4, 4*a*, respectively. Such construction of the line allows the electromagnetic field of the signal which is asymmetrical to ground to be concentrated as fully as possible in the dielectric plate 1 and at the same time allows a use of terminal points for the symmetrical line 9, 9*a*. In this manner, the symmetrical lines can run parallel to each other on the same side of the plate as illustrated in FIG. 1 or, alternatively, can extend parallel to each other on opposite sides of dielectric plate 1 as illustrated in FIG. 2. Such arrangement allows several different possibilities for connecting the load which is symmetrical to ground.

FIG. 2 illustrates a modification of the balanced converter wherein the basic construction is similar to that illustrated in FIG. 1. The only difference is that the symmetrical lines such as 9 and 9*a* in FIG. 1 have been replaced by lines 10 and 10*a* which are attached to opposite sides of the dielectric plate 1 and thus are in two separate planes one above the other. In FIG. 2, only the conductor 3 has been attached to a feed line 10 which extends at right angles to it on the first side of the plate 1. The second conductor path 10*a* of the symmetrical line is attached to the lower surface of the plate 1 and connects to the conductive path 6 which is a quarter wave length long and forms a ground line and which is arranged opposite the conductive path 4. The conductive path 4 does not have a feedline on the upper surface in the embodiment of FIG. 2 but the feedline 10*a* provides the other symmetrical line as illustrated in FIG. 2.

The embodiments illustrated in FIGS. 1 and 2 and both of which comprise the conductor path 2 arranged on the first surface of the dielectric plate 1 form a compensated balanced device which allows balancing to take place with low reflection over a wide frequency range. By connecting the conductor path 2 to one of the two conductor paths 3*a*, 4*a* which have approximately one quarter wave length and are arranged on one side of the conductor path 2 a simple form of a device is achieved.

Figure 3:
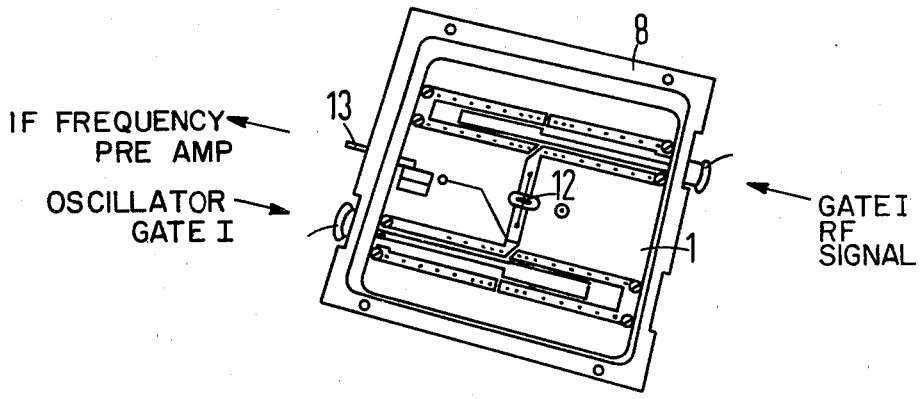
FIG. 3 illustrates a RF modulator comprising two balanced converters such as illustrated in FIG. 2.

FIG. 3 is a perspective view of a RF modulator which is constructed from two balanced converters such as shown in FIG. 2. In this embodiment a first balanced converter such as illustrated in FIG. 2, is connected to a second balanced converter of identical construction and the first and second balanced converters lie in the same plane. In the end zone of the symmetrical strip lines 10, 10*a* the dielectric plate has a recess 12 in which are mounted the non-linear elements—a diode quartet of the modulator. A connecting link extends from the symmetrical strip line to a terminal 13 formed in the housing 8 which forms the output to an IF preliminary amplifier. The gates I and I′ provide the outputs of the line which is asymmetrical to ground for the RF signal or the oscillator signal.

The balanced converters according to the invention can be used to construct RF modulators and similar electrical assemblies which have low noise level over a relatively wide frequency band and also have good decoupling between the oscillator gate and the signal gate. The circuit is very simple to construct. The dielectric plate may consist, for example, of glass fiber reinforced teflon which is connected to the housing at only 4 points and lack of tolerance in the housing does not influence the electrical characteristics of the modulator and, thus, the housing need not be constructed with great accuracy and can be cheaply constructed. The housing may be produced for example as a hot pressed component which does not require elaborate finishing.

Figure 4:
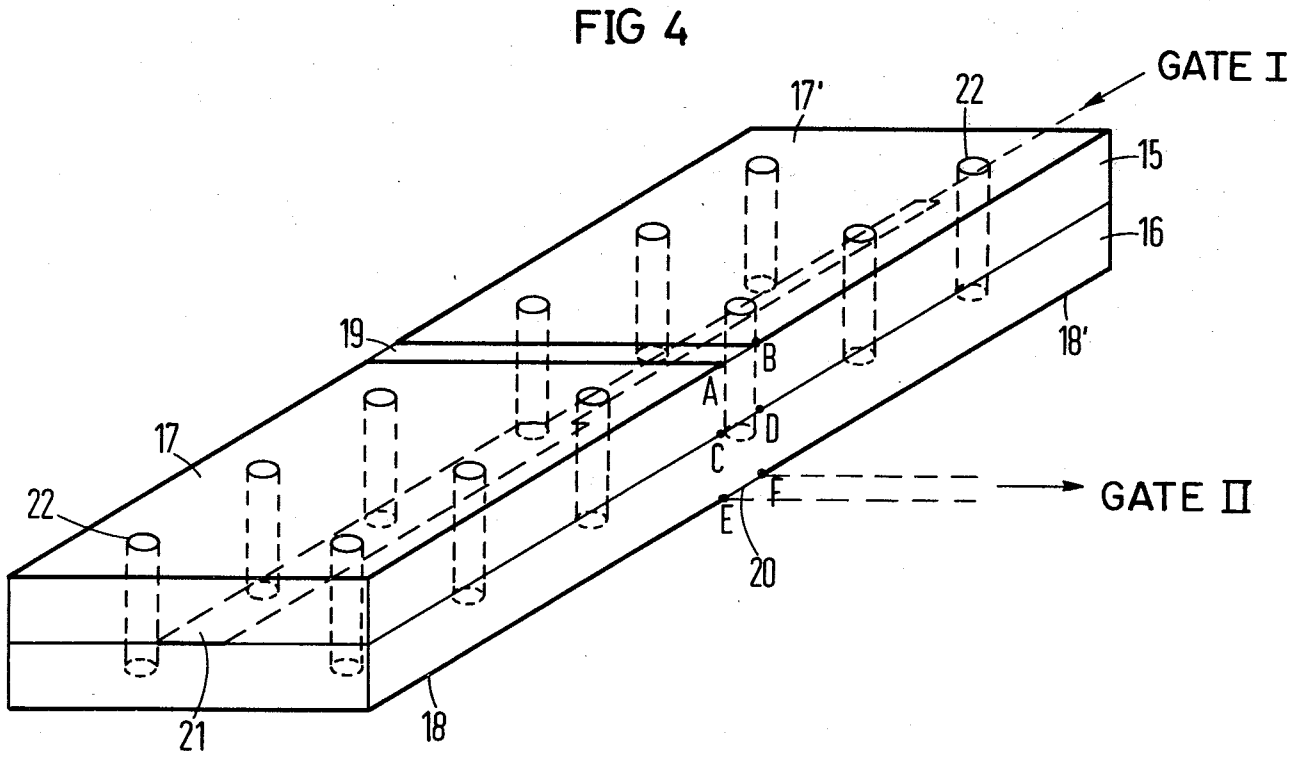
FIG. 4 illustrates a balanced converter formed in Triplate technology.

FIG. 4 illustrates a modification of the invention comprising a balanced converter constructed in Triplate technology. In this embodiment, two dielectric plates 15 and 16 are attached together. Plate 15 has two separate regions at opposite ends of metallized coatings 17 and 17′ separated by an insulated gap 19. Likewise, the plate 16 has two regions 18 and 18′ of metallized coatings separated by a gap 20 which is aligned with the gap 19. The contacting sides of the plates 15 and 16 are not provided with conductive coatings except for a conductive path 21 which extends on the plane between the plates 15 and 16 as illustrated in FIG. 4. The metal coating 17 is connected to the metal coating 18 by through contacts 22 which extend through the plates 15 and 16 and the plates 17′ and 18′ are electrically connected together by through contacts 22 as illustrated. Alternatively, the edges of the plates 15 and 16 may be metallized so as to electrically connect layer 17 with layer 18 and layer 17' with layer 18' respectively.

The asymmetrical line connected to gate I is formed by the conductor path 21 and one of the ground coatings 17' or 18'. The symmetrical signal can be removed from the gate II between the terminal points A and B that is the coatings 17 and 17' on the dielectric plate 15 or the terminal points C–D the terminal points of the ground coating which extend into the plane of the conductor path 21 with through contacts, the terminal points E–F which are respectively connected to the ground coatings 18 and 18' on the dielectric plate 16 or the terminal points A–F or the terminal points B–E, D–E or C–F. Gates I and II are illustrated in FIGS. 1, 2 and 4.

By assembling two balanced converters in Triplate technology and inserting the corresponding non-linear elements, it is advantageously possible to construct a RF modulator in the manner described above in microstrip technology.

Although the invention has been described with respect to preferred embodiments, it is not to be so limited as changes and modifications can be made which are within the full intended scope of the invention as defined by the appended claims.

I claim as my invention:

1. A balanced converter for the microwave range, characterized by a construction in microstrip technology with a first metallic conductor path (2) arranged on one surface of a dielectric plate (1) mounted in a metallic housing (8), and second, third, fourth and fifth metallic conductor paths (3, 4 and **3*a*, 4*a*) each of which have an approximate length of $\lambda/4$ and with the second and fourth conductor paths mounted on one side of the first conductor path and with the third and fifth conductor paths mounted on the other side of the first conductor path (2), sixth and seventh wider metallic conductor paths (5, 6) which have an approximate lengths of $\lambda/4$ and form an earth line and mounted on the opposite surface of the plate (1), where $\lambda$ is a wavelength in the operating range of the converter, the ends of said sixth and seventh conductor paths electrically connected to said metallic housing (8), said second and third conductor paths connected to said sixth conductor path, said fourth and fifth conductor paths connected to said seventh conductor path, and said second and fourth conductor paths (3, 4) which are arranged on one side of the first conductor path (2) are each connected at their ends to eighth and ninth conductor paths (9, 9*a*) which are mounted on said one side and extend in the plane of said plate at right angles to other paths (FIG. 1**).

2. A balanced converter as claimed in claim 1 wherein in the electrical connections between said second and third conductor paths and said sixth conductor path (5) and the electrical connections between said fourth and fifth conductor paths and said seventh conductor path (6) being accomplished by through contacts (11).

3. A balanced converter as claimed in claim 1 characterized in that said first metallic conductor path (2) is insulated by said dielectric plate.

4. A balanced converter for the microwave range, characterized by a construction in microstrip technology with a first metallic conductor path (2) arranged on one surface of a dielectric plate (1) mounted in a metallic housing (8), and second, third, fourth and fifth metallic conductor paths (3, 4 and **3*a*, 4*a*) each of which have an approximate length of $\lambda/4$ and with the second and fourth conductor paths mounted on one side of the first conductor path and with the third and fifth conductor paths mounted on the other side of the first conductor path (2), sixth and seventh wider metallic conductor paths (5, 6) which have an approximate lengths of $\lambda/4$ and form an earth line and mounted on the opposite surface of the plate (1), where $\lambda$ is a wavelength in the operating range of the converter, the ends of said sixth and seventh conductor paths electrically connected to said metallic housing (8), said second and third conductor paths connected to said sixth conductor path said fourth and fifth conductor paths connected to said seventh conductor path, and said second conductor path (3) is connected at its end to an eighth conductor path (10) and said seventh conductor path (6) which is mounted on the opposite side is connected at its end to a ninth conductor path (10*a*) and both said eighth and ninth conductor paths (10 and 10*a*) extend in the plane of said plate at right angles to the other paths (FIG. 2**).

5. A balanced converter as claimed in claim 4 wherein in the electrical connections between said second and third conductor paths and said sixth conductor path (6) and the electrical connections between said fourth and fifth and seventh conductor paths being accomplished by through contacts (11).

6. A balanced converter as claimed in claim 4 characterized in that said first metallic conductor path (2) is insulated by said dielectric plate.

7. A balanced converter for the microwave range constructed in Triplate technology in such manner comprising two dielectric plates (15, 16) mounted together and two metallic coatings (17, 17') mounted on one surface of one plate (15) and two metallic coatings (18, 18') mounted on one surface of the other plate (16) said coatings (17, 17' and 18, 18') extend in the longitudinal direction of said plates and are respectively separated from each other by a gap (19, 20) and said two plates having between their non-metallized surfaces which are arranged against each other, a fifth conductor path (21) which runs in the longitudinal direction of the plates (15, 16), and said fifth conductor path (21) and a metallic coating (17 or 17') of one dielectric plate (15) form the asymmetrical input (gate I), whereas the metallic coatings (18, 18') of the other dielectric plate (16) form the symmetrical output (gate II) of the converter (FIG. 4).

8. A balanced converter as claimed in claim 7, characterized in that said metallic coatings (17 and 18, and 17' and 18') which are mounted opposite one another on the outer surfaces of the dielectric plates (15, 16) are electrically connected to each other.

9. A balanced converter as claimed in claim 8, characterized in that the electrical connection between coatings (17 and 18) and (17' and 18') is made by through contacts (22).

* * * * *